US005989134A

United States Patent [19]

Antonious

[11] Patent Number: 5,989,134

[45] Date of Patent: Nov. 23, 1999

[54] METALWOOD TYPE CLUB HEAD WITH REINFORCED OUTER SUPPORT SYSTEM

[76] Inventor: Anthony J. Antonious, 7738 Calle Facil, Sarasota, Fla. 34238

[21] Appl. No.: 09/081,948

[22] Filed: May 21, 1998

[51] Int. Cl.[6] ..... A63B 53/04

[52] U.S. Cl. ..... 473/327; 473/328; 473/345; 473/349

[58] Field of Search ..... 473/324, 345, 473/349, 327, 328; D21/733, 734, 735

[56] References Cited

U.S. PATENT DOCUMENTS

D. 390,616 2/1998 Maltby .
4,332,388 6/1982 Crow .
5,193,810 3/1993 Antonious .
5,203,565 4/1993 Murray .
5,335,914 8/1994 Long .
5,465,970 11/1995 Adams .
5,658,206 8/1997 Antonious ..... 473/328
5,766,095 6/1998 Antonious ..... 473/345

*Primary Examiner*—Sebastiano Passaniti
*Attorney, Agent, or Firm*—Aquilino, Welsh & Flaxman

[57] ABSTRACT

A metalwood type golf club head is disclosed having a reinforced outer support system formed of elongated support bands providing additional strength and mass on the outer side walls, rear, bottom and crown areas for added overall club head strength, increased stability and control when ball contact occurs during a high velocity club head swing.

29 Claims, 10 Drawing Sheets

FIG. 28
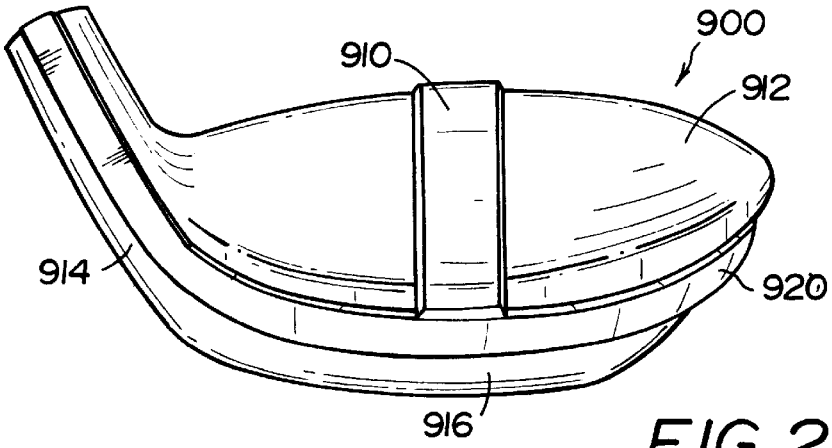
FIG. 29
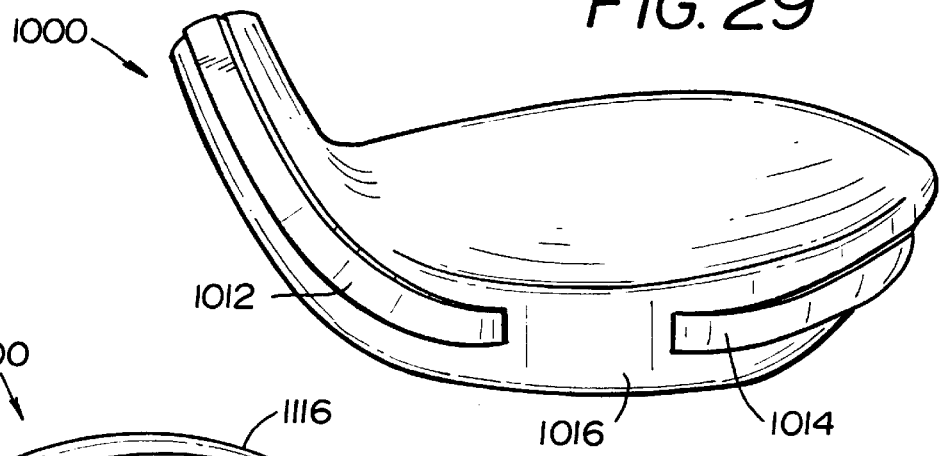
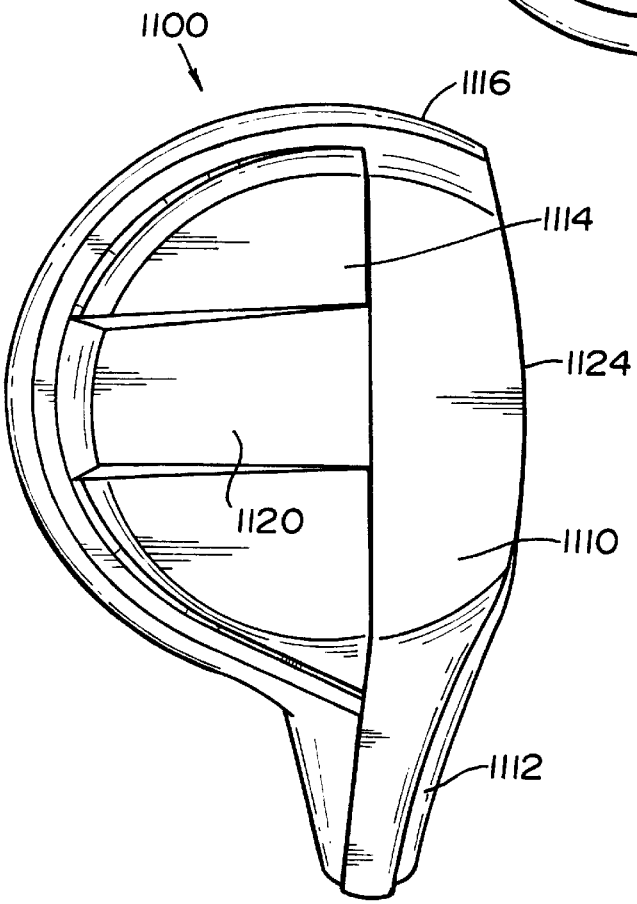
FIG. 30

FIG. 31
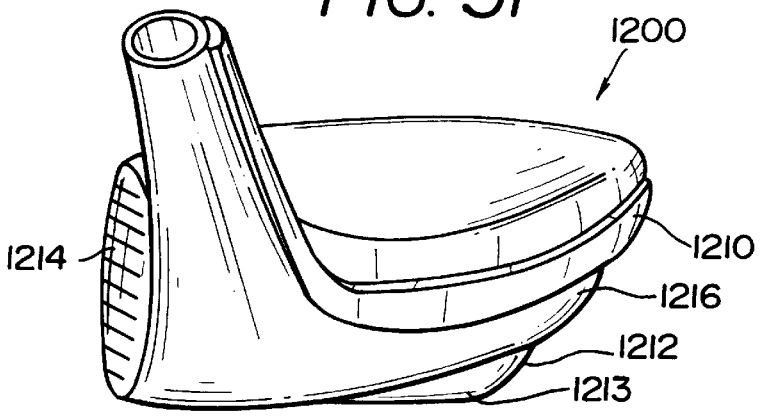
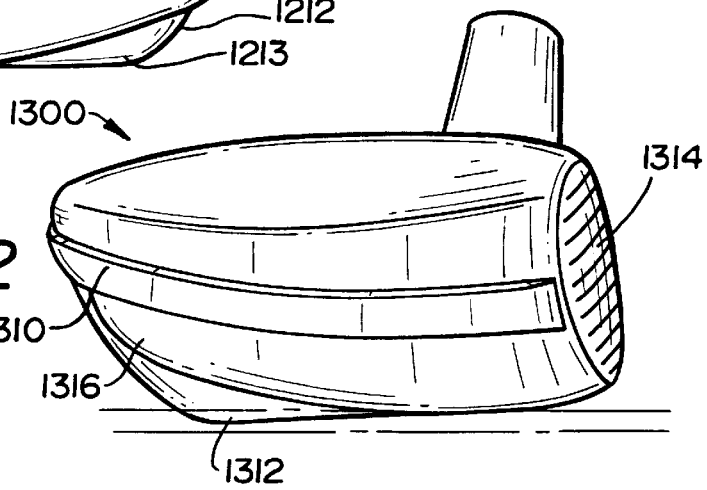
FIG. 32
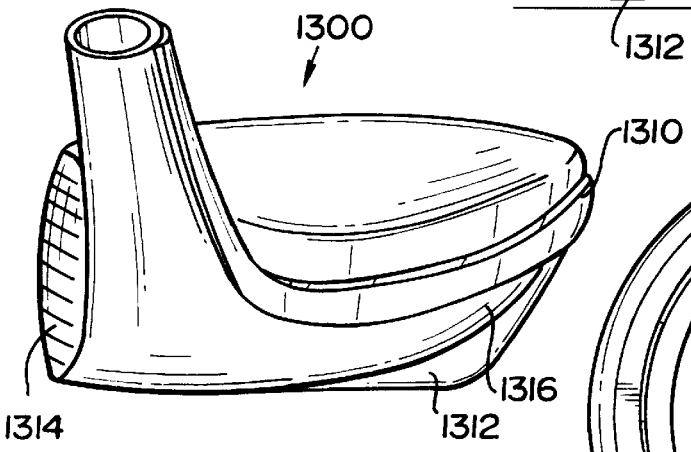
FIG. 33
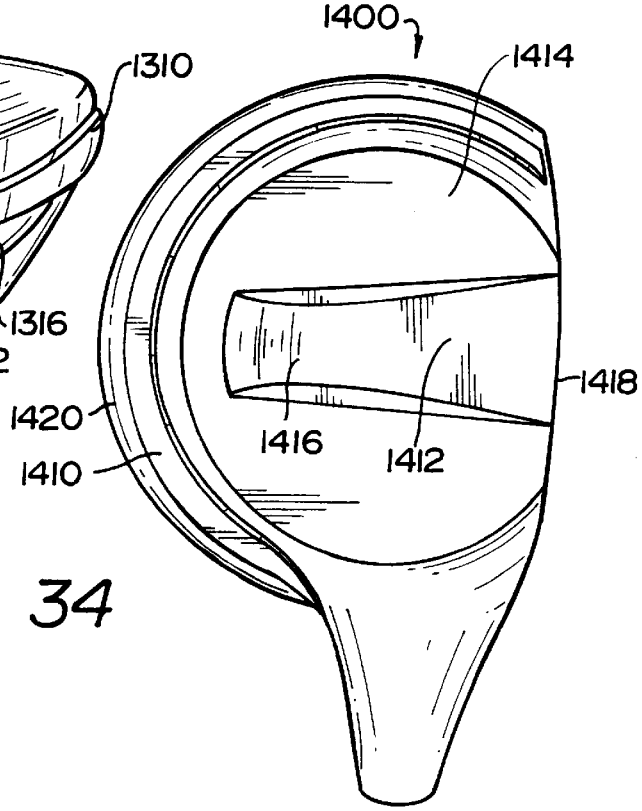
FIG. 34

METALWOOD TYPE CLUB HEAD WITH REINFORCED OUTER SUPPORT SYSTEM

BACKGROUND OF THE INVENTION

The present invention relates to a metalwood type golf club head, and in particular, to a metalwood club head having an improved reinforced outer support system.

The majority of wood type golf club heads manufactured today are made of various types of metals and other suitable materials and are formed with a hosel, a club head body formed by a metal shell having thin side walls and upper crowns, connected to a more substantial or reinforced frontal ball striking face to absorb the impact of a golf ball when it is struck by the club head. Typically, the metal shell is then interfaced or joined with a stronger sole plate to complete the club head. Normally, there is no substantial support means to reinforce the side walls and the thin upper crown sections of a club head. Thus, the overall structure of the club head, with an inner reinforced ball striking face, and thinner unreinforced surrounding outer shell sections do not minimize overall adverse club head feel or distortions that occur when off center ball contact is made.

Furthermore, metalwood club heads currently are being made larger and larger to induce a golfer to purchase a golf club in the belief that the larger heads make it easier to contact a golf ball. Such larger heads have still thinner side walls and are typically made of stronger metal such as titanium and other suitable materials. However, the larger club heads require more surrounding reinforcement means to produce a solid feel and stability at impact for greater accuracy and further distance. Various attempts have been made to reinforce metalwood type club heads, mostly to support the interior of the shell, particularly behind the club face and under the upper crown surface of the club head. Limited success has been provided by these efforts to improve club head stability at impact when a golf ball is struck.

Prior art U.S. patents disclosing various reinforcing systems. U.S. Pat. No. 3,847,399 to Raymont reinforces the rear inner surface of the ball striking face with a honeycomb structure. U.S. Pat. No. 4,214,754 to Zebelean shows a metalwood golf club head having inner reinforcing ribs which extend internally below the top crown and form a bridge to the ball striking face. U.S. Pat. No. 4,511,145 to Schmidt shows a hollow metalwood club head reinforced by an internal metal ridge integral with the front wall and extending longitudinally and downwardly from a central region toward the heel and toe portions of the club head.

My own U.S. Pat. No. 5,141,230, reinforces the interior of a metalwood with a first mass located behind the ball striking face and a second mass under the upper or crown surface of the club head. Another of my own U.S. Patents, U.S. Pat. No. 5,482,279 includes a peripheral weighting and reinforcement system that provides additional mass along the majority of the interface of the ball striking face and the crown of the club head. A metalwood golf club currently marketed by McHenery Metals, shows an outer reinforcing member adjacent the rear surface of the club head.

SUMMARY OF THE INVENTION

The metalwood reinforced outer support system of the present invention provides an outer longitudinal reinforcing or brace member attached to the outer surfaces of the metalwood shell body at various locations including the side wall surfaces, rear surfaces, top surface, bottom surface and hosel. A first embodiment includes a single reinforced outer supporting, ribbon shaped, band forming a brace member and extending across the side walls from the toe section, across the rear section, the heel section and onto the hosel of the club head. This reinforcing system forms a unitized bracing structure overlaying the outer surfaces and surrounding the club head from the heel to the toe sections. Additional embodiments include an auxiliary band shaped support located across the sole parallel to the club face which connects to opposing sections of the primary reinforced outer support at the heel and toe sections.

Another embodiment includes a skimmer sole located perpendicular to the club face which is connected to the reinforcing brace at the rear surface of the club head. This embodiment provides a more unitized outer support system since it overlays the side walls of the heel and toe sections, rear section and sole. The structure produces a much firmer and stronger club head that offers a formidable encircling support system that resists stress, buckling, twisting, shock, vibration and other adverse club head distortions that can occur at impact during the execution of a high velocity golf swing.

Other embodiments provide a single or dual auxiliary support band that overlays the crown surfaces of the club head in a front to rear direction. The auxiliary support band structure is connected to the support brace encircling the side walls and rear section of the club head between the heel and the toe.

Still other preferred embodiments of the reinforced outer support system include various combinations of the above described support structures. This unusual metalwood support construction provides a unique reinforcing outer support system that surrounds and overlays the critical surfaces of the club head that are most vulnerable to damaging effects of stress, cracking, buckling, vibration, and other diverse distortions that can often occur when ball contact occurs off of the center of the ball striking face. The superior structure of all the embodiments of the present invention provides substantial mass to adequately reinforce the specific outer surfaces of the critical areas that are affected and can be accomplished without increasing the overall thickness and weight of the side walls and crown of the club head.

Among the objects of the present invention are the provision of a metalwood type golf club head that provides improved performance by reinforcing the normally weaker outer body shell sections of a metalwood type club head.

Another object of the present invention is the provision of a metalwood having an improved outer support system for added strength and club head stability at impact.

To achieve the objects and in accordance with the purpose of the present invention, as embodied and broadly described herein, the invention embodies a metalwood type golf club head comprising a club head body including a heel, toe, bottom sole, upper surface, ball striking face and a rear surface wherein the ball striking face intersects with a forwardmost progression of the bottom sole to define a leading edge; and a hosel integrally connected to the club head body. The improvement is the use of a reinforced outer support system, preferably extending from the toe, around the rear to the heel and onto the hosel which forms an outer unitized reinforced, ribbon shaped structure surrounding the club head body, thereby providing greater stability of the club head at impact, producing more solid shots for increased accuracy and longer distances. The structure greatly minimizes adverse club head distortions such as buckling of side walls, twisting and torquing, knock-back, shock to the hands of the golfer and excess vibration when high velocity swings impact a golf ball on the club face. In addition to providing substantial reinforcement to all critical areas of the club head, the outer support system may be formed with significant preferred mass to permit precise distribution of club head weight to more effectively alter the preferred location for the center of gravity to produce the desired feel and improve performance characteristics. The reinforced outer support system also creates a club head that visibly reveals where its formidable unique support members are located to provide superior advantages not found in any other metalwood type club heads.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 28 is a rear elevational view of the golf club of FIG. 27.

FIG. 29 is a rear elevational view of an eleventh embodiment of a golf club head in accordance with the present invention.

FIG. 30 is a bottom view of a twelfth embodiment of a golf club head in accordance with the present invention.

FIG. 31 is a heel side elevational view of a thirteenth embodiment of a golf club head in accordance with the present invention.

FIG. 32 is a toe side elevational view of a fourteenth embodiment of a golf club head in accordance with the present invention.

FIG. 33 is a heel side view of the golf club head of FIG. 32.

FIG. 34 is a bottom view of a fifteenth embodiment of a golf club head in accordance with the present invention.

DESCRIPTION OF THE PREFERRED EMBODIMENTS

Figure 1:
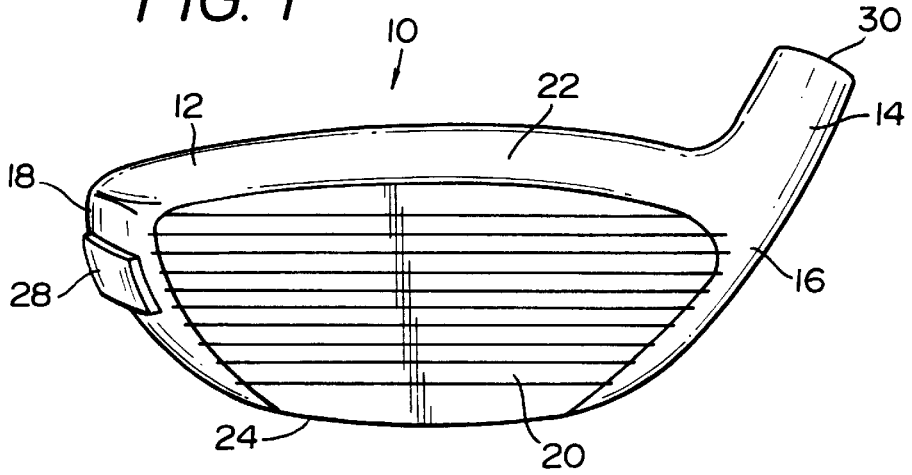
FIG. 1 shows a front elevational view of a golf club head in accordance with the present invention.
Figure 2:
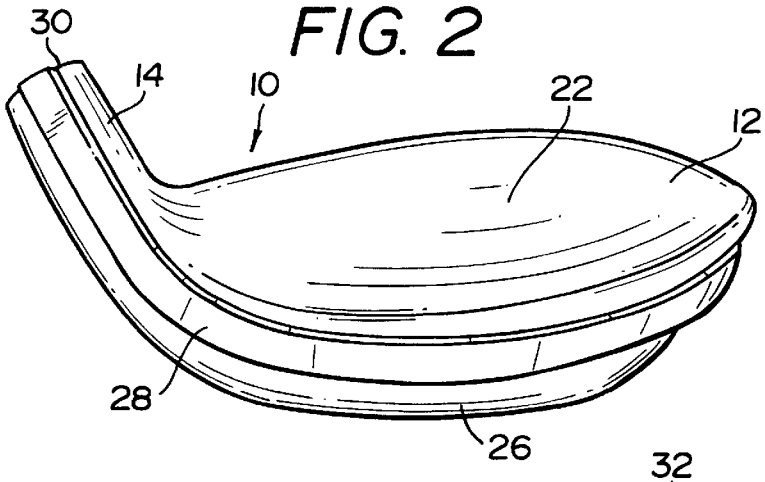
FIG. 2 is a rear elevational view thereof.
Figure 3:
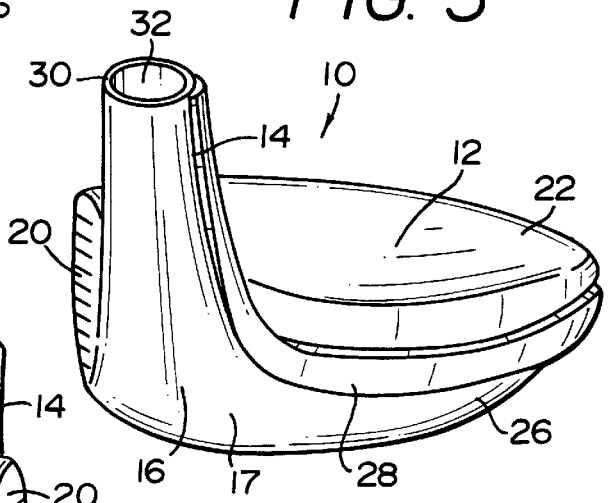
FIG. 3 is a heel end elevational view thereof.
Figure 4:
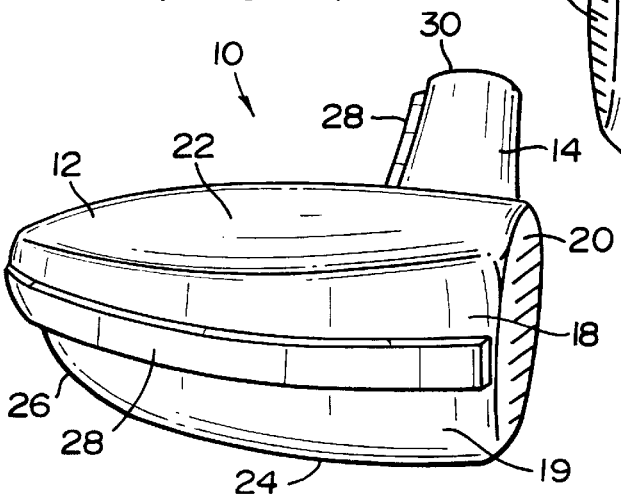
FIG. 4 is a toe end elevational view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, FIGS. 1–4 show a first embodiment of a metalwood type golf club head 10 in accordance with the present invention. The club head 10 includes a club head body 12 and hosel 14. The club head body 12 is conventional and includes a heel 16, heel side wall 17, toe 18, toe side wall 19, ball striking face 20, top surface 22, bottom or sole surface 24 and rear surface 26. The improvement resides in an elongated ribbon shaped brace or support 28 which extends from a point adjacent the ball striking face 20 on the toe 18, wraps around the rear surface 26, to the heel 16 and upwardly onto the hosel 14 on a rear portion thereof, terminating at a top edge 30 adjacent an opening 32 for insertion of a conventional golf club shaft, not shown.

This arrangement provides a unitized connection between the toe 18, rear surface 26, heel 16 and hosel 14, which sections are connected by the elongated ribbon shaped brace 28.

Figure 5:
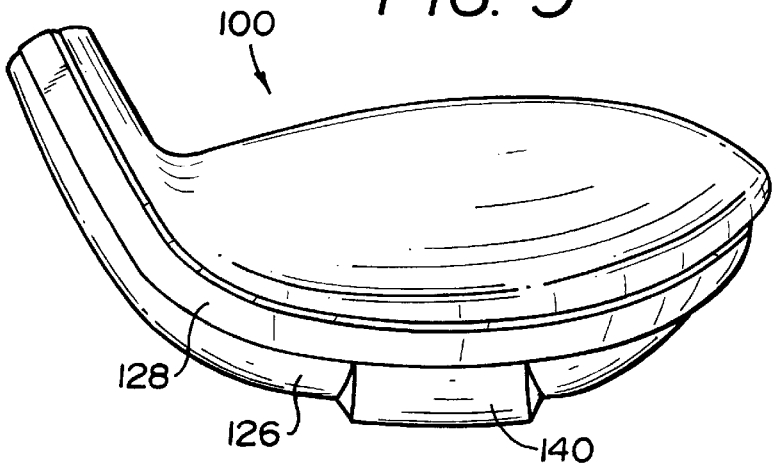
FIG. 5 is a rear elevational view of a second embodiment in accordance with the present invention.
Figure 6:
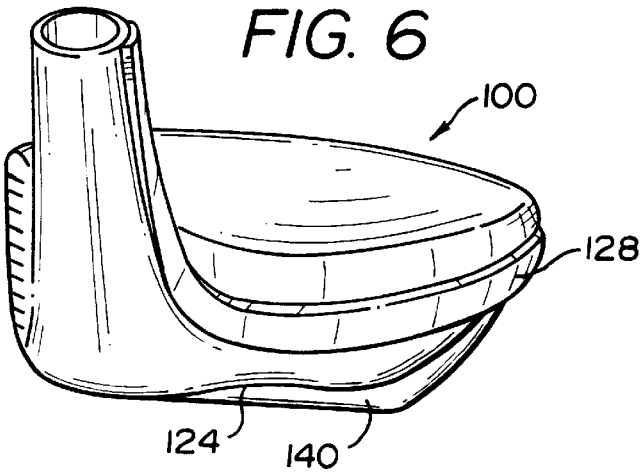
FIG. 6 is a heel end view of the embodiment of FIG. 5.
Figure 7:
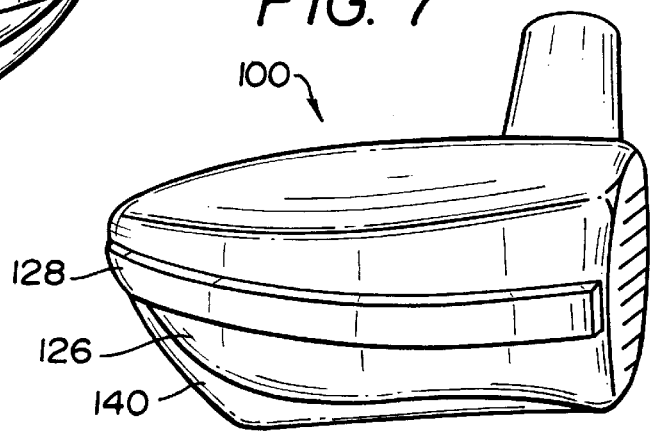
FIG. 7 is a toe end elevational view of the embodiment of FIG. 5.

FIG. 5, 6 and 7 illustrate a second embodiment of a golf club head 100 in accordance with the present invention. In this embodiment, the club head 100 is identical to that described with respect to FIGS. 1–4, including an elongated ribbon shaped support brace 128 and further includes a skimmer 140 on the bottom sole 124 which extends upwardly across the rear surface 126 and connects with the support band 128 further stabilizing the golf club head 100.

Figure 8:
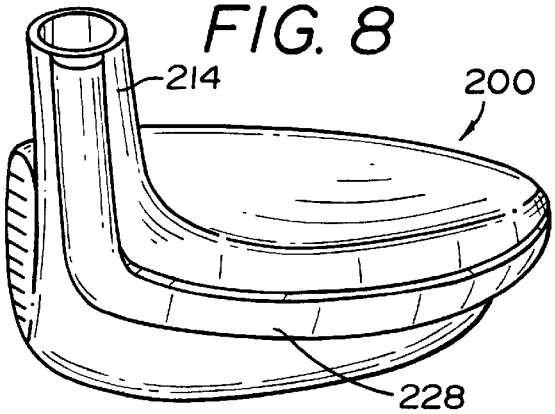
FIG. 8 is a heel end elevational view of a third embodiment of the present invention.
Figure 9:
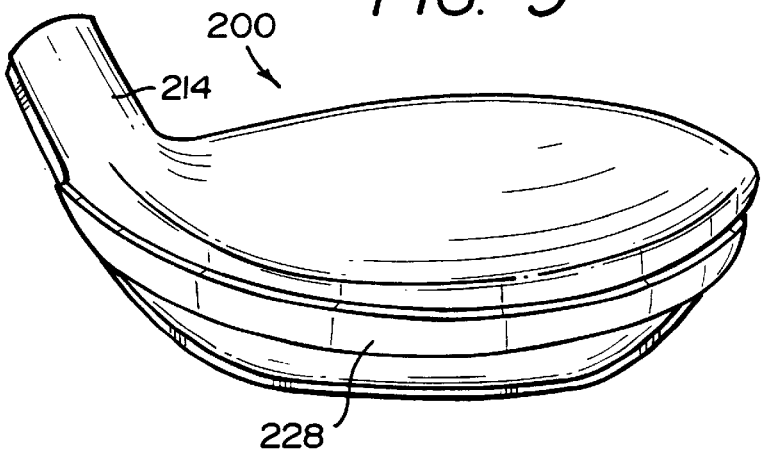
FIG. 9 is a rear end elevational view of the embodiment of FIG. 8.

FIGS. 8 and 9 show a third embodiment of a golf club head 200 in accordance with the present invention. This embodiment is identical to the embodiment shown in FIGS. 1–4, with the exception that a reinforcing band 228 extends upwardly onto a side surface of the hosel 214.

Figure 10:
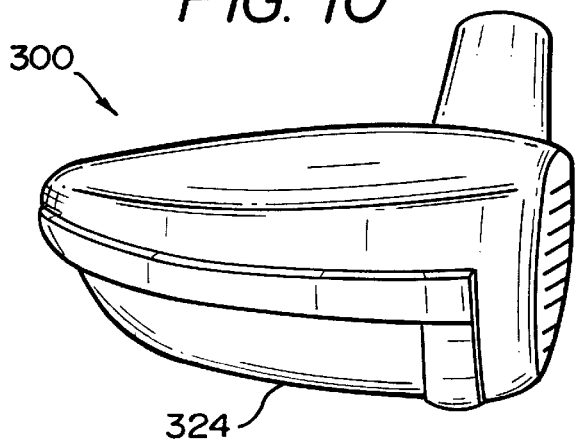
FIG. 10 is a toe end elevational view of a fourth embodiment of the present invention.
Figure 11:
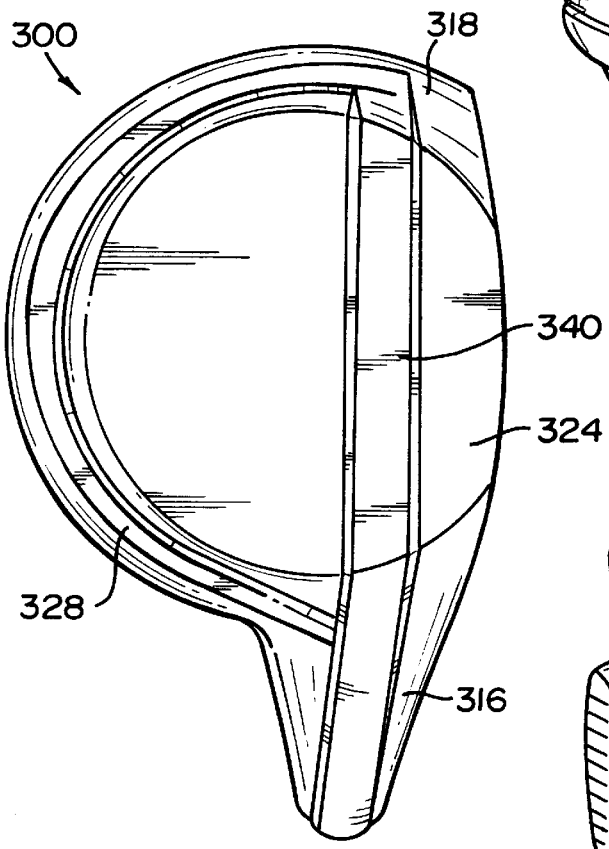
FIG. 11 is a bottom view of the embodiment of FIG. 10.
Figure 12:
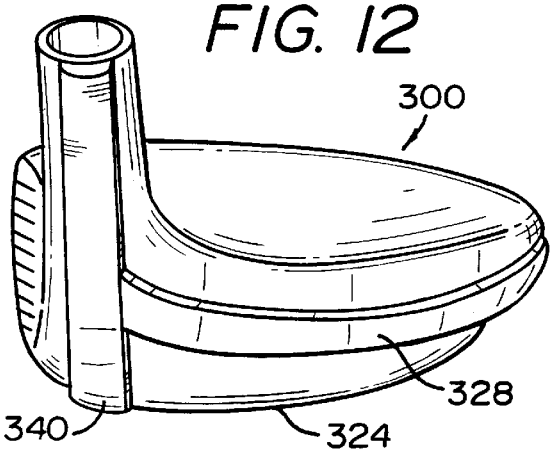
FIG. 12 is a heel end elevational view of the embodiment of FIG. 10.
Figure 13:
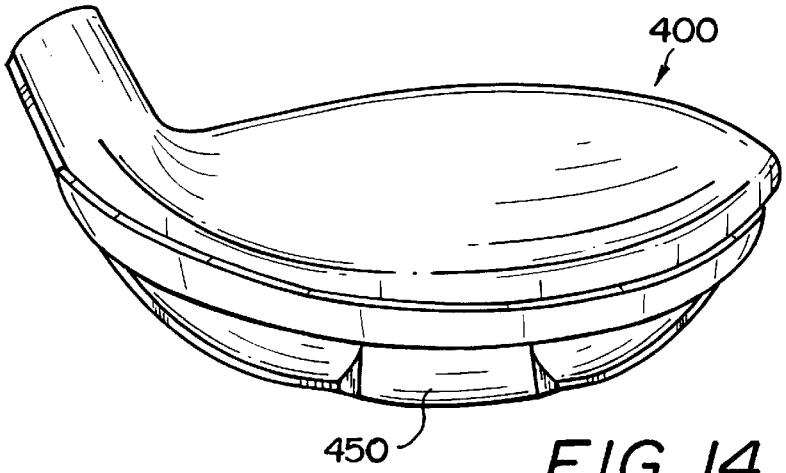
FIG. 13 is a rear elevational view of a fifth embodiment of the present invention.
Figure 14:
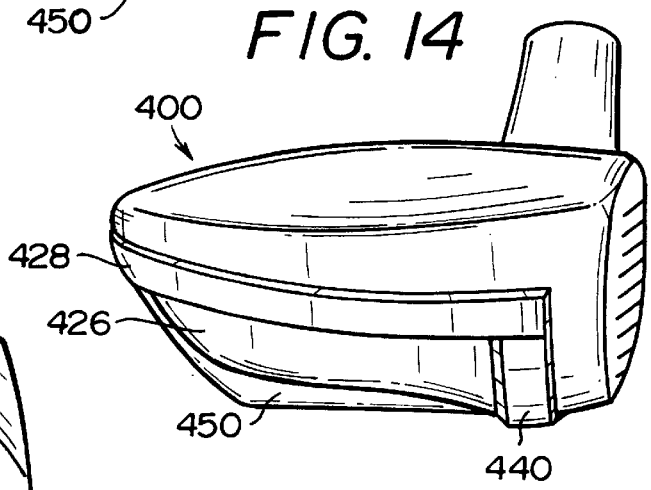
FIG. 14 is a toe end elevational view of the embodiment of FIG. 13.
Figure 16:
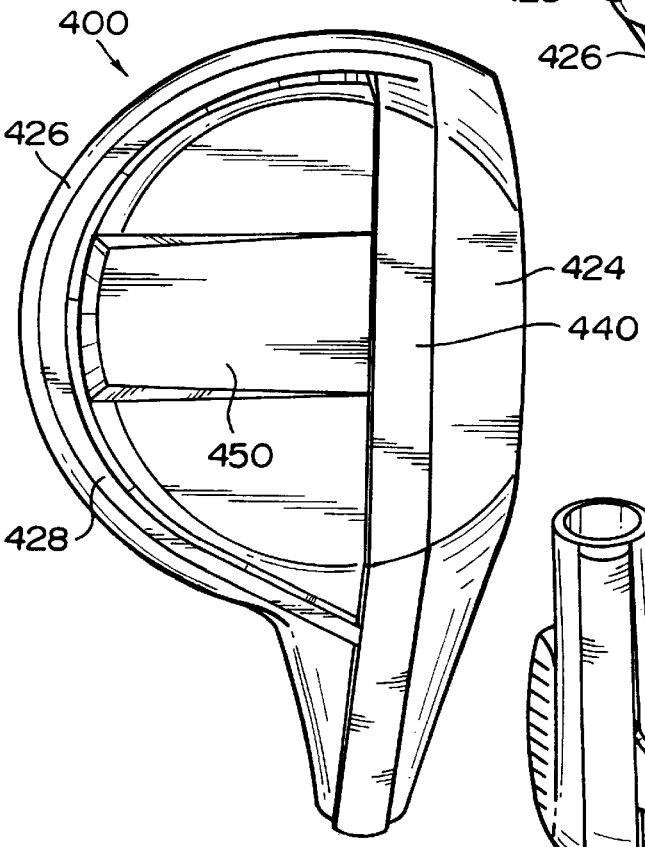
FIG. 16 is a bottom view of the embodiment of FIG. 10.
Figure 15:
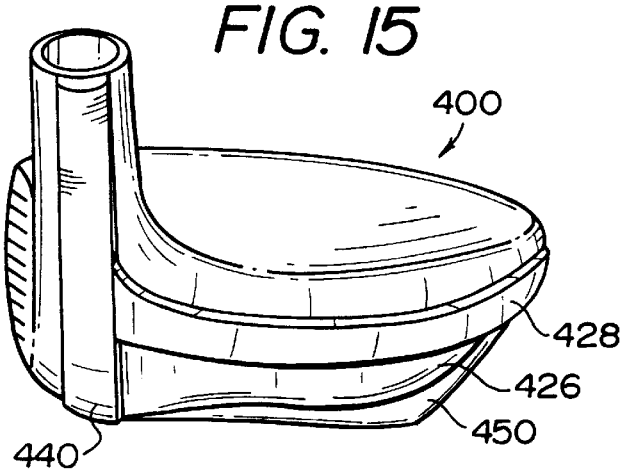
FIG. 15 is a heel end elevational view of the embodiment of FIG. 13.
Figure 18:
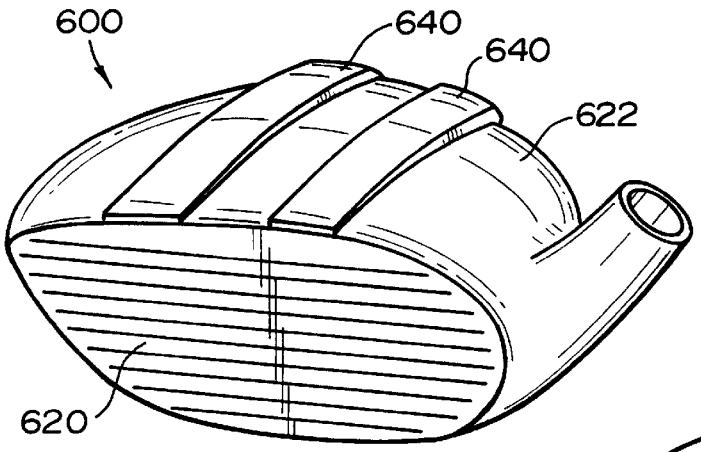
FIG. 18 is a top perspective view of a seventh embodiment of the present invention.

FIGS. 10–12 show a fourth embodiment of a golf club head 300 which is identical to the embodiment shown in FIGS. 8 and 9, with the exception of a secondary reinforcement band 340 extending across the bottom surface 324 and connecting to the reinforcement band 328 at a point adjacent the toe 318 the heel 316 of the club head 300.

FIGS. 13–16 show a fifth embodiment of a golf club head 400 which is identical to the embodiment shown in FIGS. 10–12, with the addition of a skimmer 450 located on the bottom surface 424 and connected between auxiliary support band 440 and support band 428 at the rear surface 426 of the club head 400. The skimmer 450 extends in a front to rear direction from the auxiliary band 440 to the rear surface 426.

Figure 17:
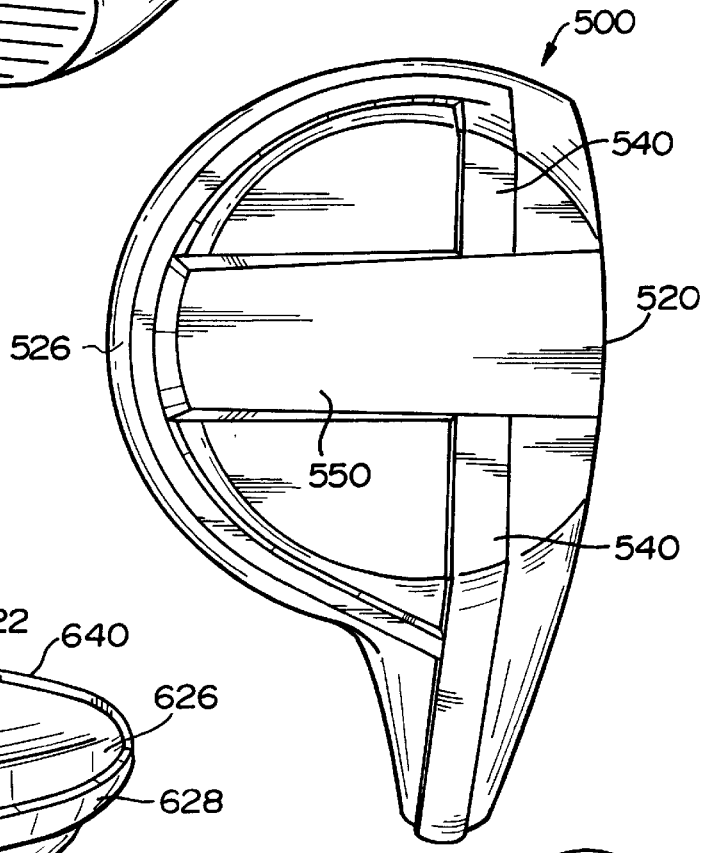
FIG. 17 is a bottom view of a sixth embodiment of the present invention.
Figure 19:
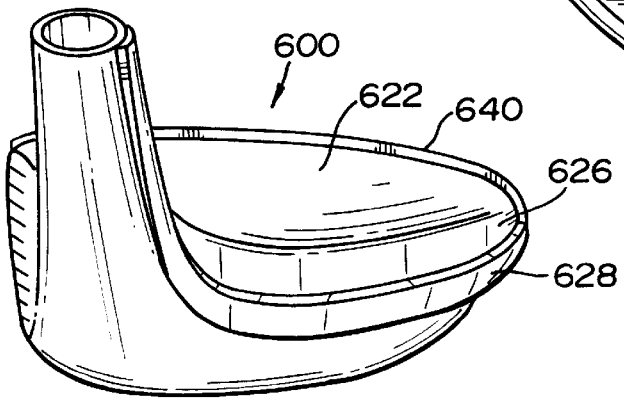
FIG. 19 is a heel elevational view elevational view of the embodiment of FIG. 18.
Figure 20:
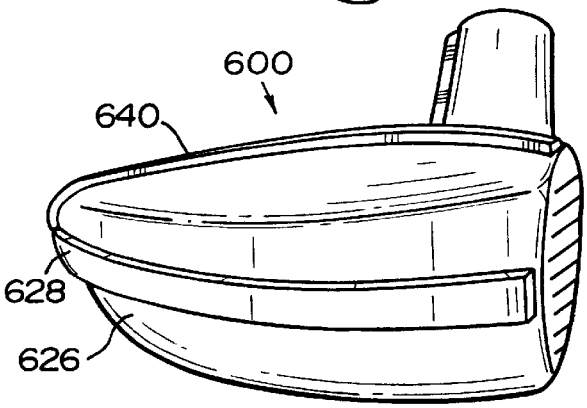
FIG. 20 is a toe elevational view of the embodiment of FIG. 18.
Figure 21:
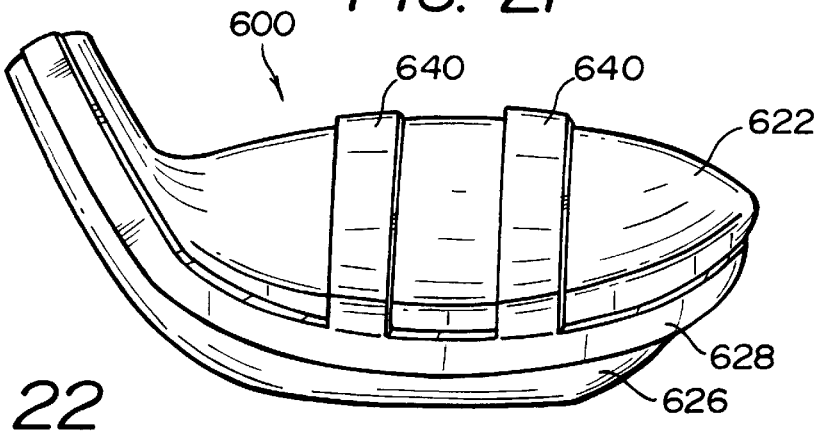
FIG. 21 is a rear elevational view of the embodiment of FIG. 18.

FIG. 17 shows a sixth embodiment of a golf club head 500 in accordance with the present invention which is identical to the embodiment shown in FIGS. 13–16 with the exception that the skimmer 550 extends from the ball striking face 520 to the rear surface 526, interrupting the auxiliary support band 540.

FIGS. 18–21 show a seventh embodiment of a golf club head 600 in accordance with the present invention. Again, this embodiment is identical to the embodiments described in FIGS. 1–4, with the addition of a pair of auxiliary brace or support members 640 extending across the top or upper surface 622 of the club head 600 from a point adjacent the ball striking face 620 onto the rear surface 626 and connecting with a support band 628. In this embodiment, the auxiliary bands 640 further reinforce the upper surface 622 of the club head.

Figure 22:
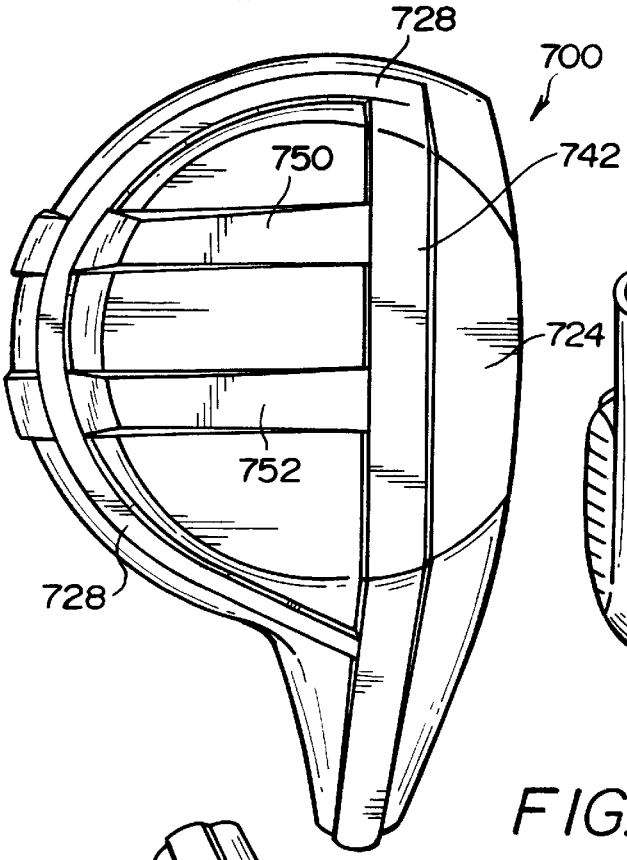
FIG. 22 is a bottom view of an eighth embodiment of the present invention.
Figure 24:
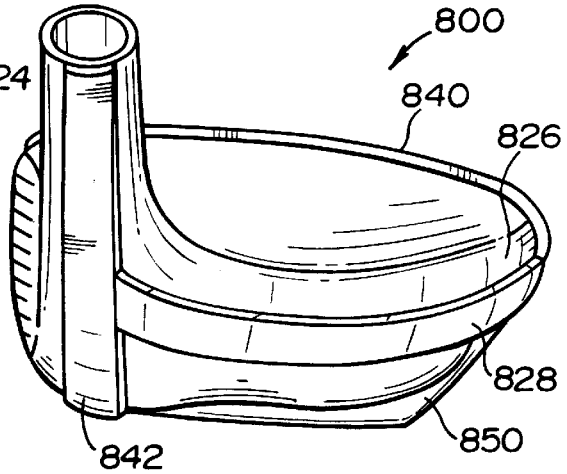
FIG. 24 is a heel elevational view of the embodiment of FIG. 23.
Figure 23:
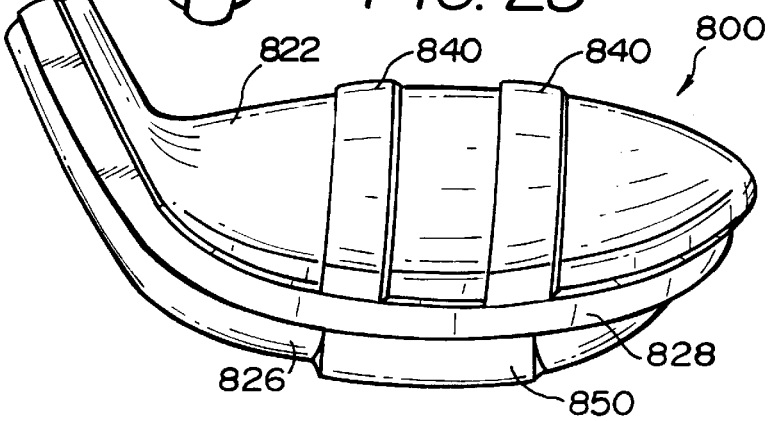
FIG. 23 is a rear elevational view of a ninth embodiment of the present invention.
Figure 25:
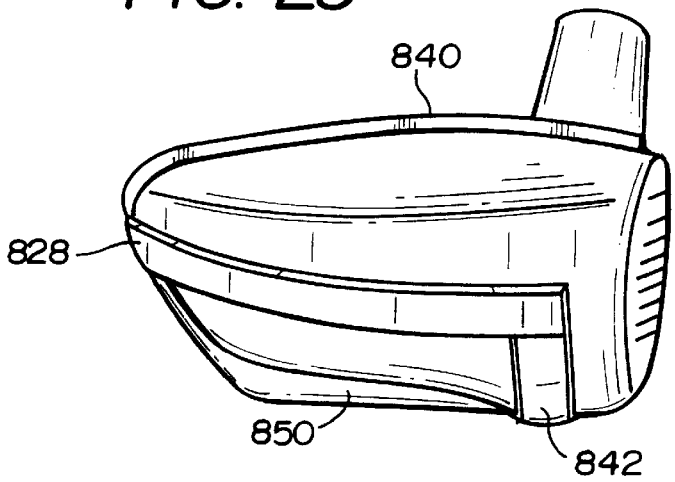
FIG. 25 is a toe elevational view of the embodiment of FIG. 23.
Figure 26:
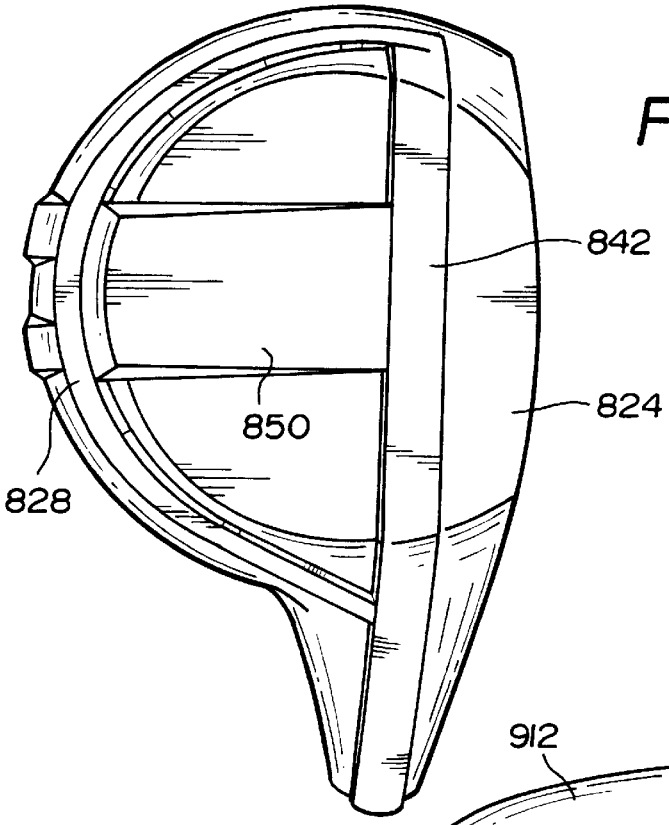
FIG. 26 is a bottom view of the embodiment of FIG. 23.

FIG. 22 shows an eighth embodiment of a golf club head 700 in accordance with the present invention which is similar to the embodiment shown in FIGS. 18–21 and further includes two skimmer members 750 and 752 formed on a bottom surface 724 which connect to a second auxiliary support band 742 and brace member 728.

FIGS. 23–26 show a ninth embodiment of a golf club head 800 in accordance with the present invention which is identical to the embodiment described in FIG. 22 and further includes a skimmer 850 formed on the bottom surface 824 which connects an auxiliary support band 842 and a support band 828. As with the previous embodiments, auxiliary bands 840 extend across the top surface 822 and connect with band 828 on the rear surface 826. Thus, this embodiment provides a totally unitized club head construction wherein support members extend on the top surface, bottom surface, side and rear surfaces and hosel of the club head 800.

Figure 27:
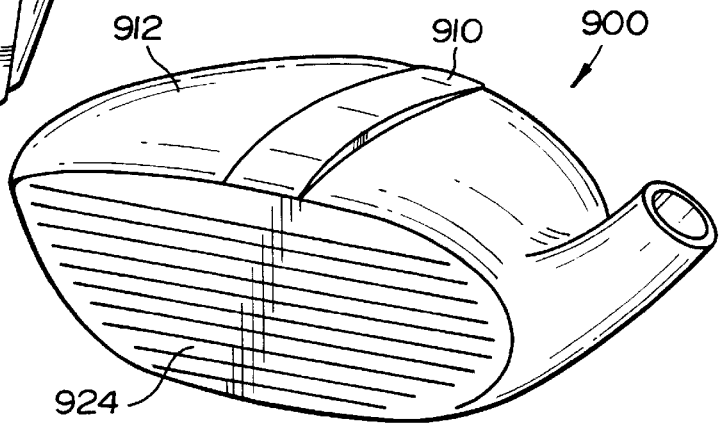
FIG. 27 shows a front perspective view of a tenth embodiment of a golf club head in accordance with the present invention.

FIGS. 27 and 28 show a tenth embodiment of a golf club head 900 in accordance with the present invention. The club head is similar in all respects to the club heads described hereinabove, except for the outer reinforcing support members including a single top surface member 910 formed on the top surface 912 of the club head 900 which interconnects to another reinforcing outer support member 920 located on the rear surface 924 and extending upwardly to the hosel 914 of the club head 900. The upper support member extends from adjacent the club face 924 to the rear 916 of the club head 900.

FIG. 29 shows an eleventh embodiment of a golf club head 1000 in accordance with the present invention and includes a reinforcing outer support system formed of a pair of separated support members 1012 and 1014 located on the rear 1016 of the club head. The support members are in line with each other and are separated at the rearwardmost portion 1016 of the club head 1000.

FIG. 30 shows a twelfth embodiment of a golf club head 1100 in accordance with the present invention including a wide and thicker reinforcing support member 1110 extending from the hosel 1112 across the bottom 1114 to the toe 1116 portion. The location of the support member 1110 locates a greater mass toward the front of the club head adjacent the bottom of the club head body. This additional mass permits the club to make more effective, solid shots particularly from fairway bunker rough and other tight lies and adverse ball positions. The structure produces greater club head stability and accuracy with a minimum loss of distance for balls hit under such normally penalizing conditions. In this embodiment, a skimmer 1120 joins the wider, raised massive support member 1110. This unique combination minimizes thin shots when ball contact occurs at the lower portion of the ball striking face 1124 on the club head 1100 because of the increased mass and energy transfer at this point.

FIGS. 31–36 show various embodiments of golf club heads having reinforcing outer surface systems in combination with various ground engaging skimmer structures to control the movement of the club head as it is swung and engages the ground support surface. It will be appreciated that these club heads are particularly adapted for use with fairway type woods having increased loft to facilitate getting a golf ball airborne when it is struck from an adverse lie condition.

Referring to FIG. 31, a thirteenth embodiment of a golf club head 1200 includes an outer reinforcing support band 1210 and a skimmer 1212 extending downwardly and rearwardly from the club face 1214 toward the rear 1216 of the club head 1200. The skimmer 1212 includes a hump or bulge 1213 just past the center on the bottom surface which permits the club head to tilt backward increasing the face loft which facilitates getting the ball airborne from fairways, bunkers, sand traps and thick turf.

FIGS. 32 and 33 show a fourteenth embodiment of a golf club head 1300 including a reinforcing outer support member 1310 and a ground engaging skimmer 1312 which slopes downwardly and rearwardly from the club face 1314 and further extends upwardly at the rear 1316 of the club head.

FIG. 34 shows a fifteenth embodiment of a golf club head 1400 in accordance with the present invention including an outer reinforcing support member 1410 and a triangular or wedge shaped sole skimmer 1412 across the sole 1414 of the club head 1400. The skimmer 1412 includes a hump 1416 located toward the rearward end of the skimmer 1412. As seen in the drawing, the skimmer is wider adjacent the club face 1418 and tapers progressively narrower toward the rear 1420 of the club head.

Figure 35:
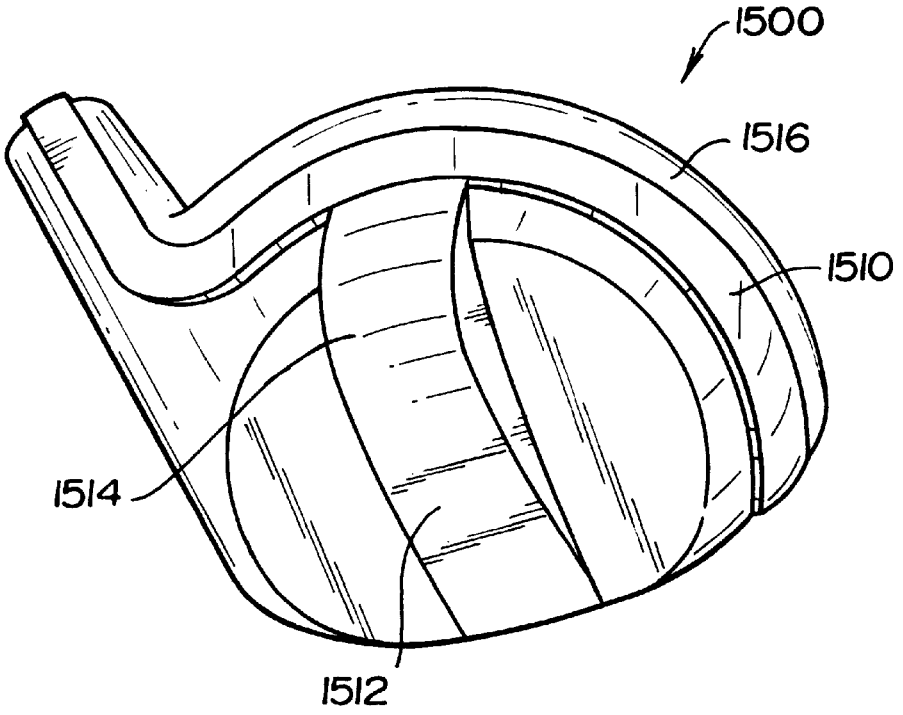
FIG. 35 is a bottom perspective view of a sixteenth embodiment of a golf club head in accordance with the present invention.

FIG. 35 shows a sixteenth embodiment of a golf club head 1500 in accordance with the present invention including an outer reinforcing band 1510 and a ground surface skimmer 1512 having a hump 1514 extending to and connecting with the band 1510 at the rear 1516 of the club head.

Figure 36:
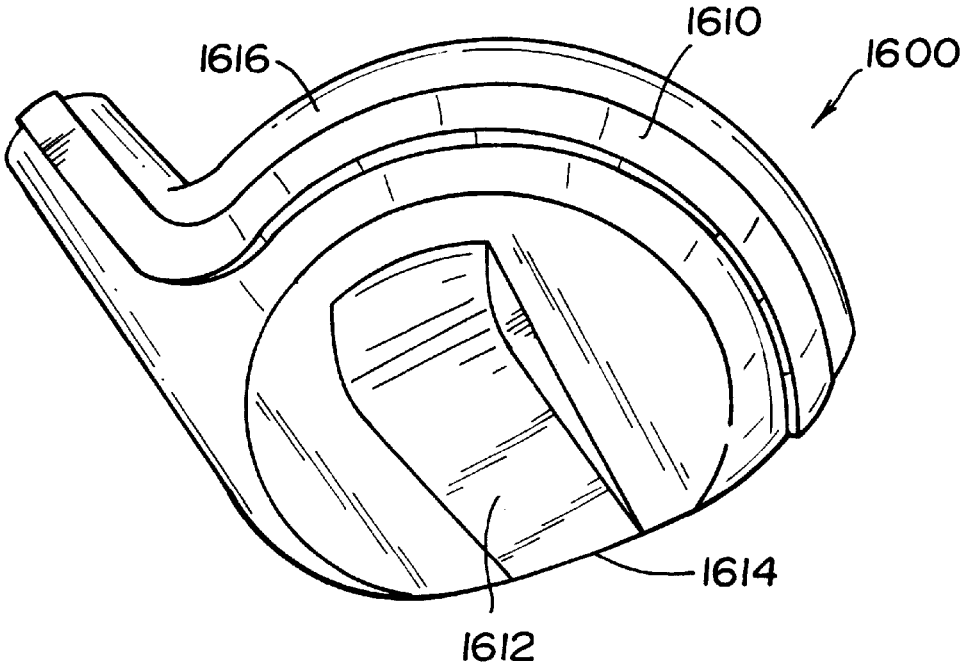
FIG. 36 is a bottom perspective view of a seventeenth embodiment of a golf club head in accordance with the present invention.

FIG. 36 shows a seventeenth embodiment of a golf club head 1600 in accordance with the present invention. The club head includes an outer reinforcing support member 1610 and a wedge shaped sole skimmer 1612 having a narrow end adjacent the club face 1614 and becoming progressively wider toward the rear 1616 of the club head 1600.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A metalwood golf club head including a hosel, a club head body having a heel, toe, bottom surface, top surface, side walls, rear surface and ball striking face wherein the improvement comprises:

an elongated, primary reinforcing outer support member formed upon and extending across said side walls and said rear surface of said club head from a point adjacent said toe to at least a point adjacent said heel of said club head; said primary reinforcing outer support being spaced from said bottom surface and said top surface.

2. The club head of claim 1 wherein said outer support is located on said side walls and rear surface approximately midway between said bottom surface and said top surface.

3. The club head of claim 1 wherein said outer reinforcing support further extends upwardly and continuously onto said hosel.

4. The club head of claim 1 further including a ground engaging skimmer on said bottom surface.

5. The club head of claim 4 wherein said ground engaging skimmer extends upwardly and rearwardly and joins said outer reinforcing support on said rear surface of said club head.

6. The club head of claim 5 further including an auxiliary outer support on said bottom surface of said club head.

7. The golf club head of claim 6 wherein said secondary outer support on said bottom surface has a width approximately ⅓ of the front to rear distance between said ball striking face and said rear surface.

8. The club head of claim 6 being further defined by said auxiliary outer support connecting to said primary support at said toe and at said heel on said club head.

9. The club head of claim 8 further including at least one auxiliary support on said top surface of said club head.

10. The club head of claim 9 wherein said auxiliary outer support band is connected with said primary outer support band.

11. The club head of claim 10 wherein said second auxiliary outer support band is connected with said primary support band.

12. The club head of claim 1 further including a second auxiliary outer support on said bottom surface.

13. The club head of claim 1 further including at least one second auxiliary outer support on said top surface.

14. The club head of claim 13 being further defined by said second auxiliary outer support being connected to said primary outer support.

15. The club head of claim 1 wherein said primary outer support extends onto a rear surface of said hosel as viewed from said rear surface of said club head.

16. The club head of claim 1 wherein said primary outer support extends onto a side surface of said hosel as viewed from the heel side of said club head.

17. The club head of claim 1 further including a skimmer on said bottom surface and an auxiliary outer support on said bottom surface, a forward edge of said skimmer being connected to said auxiliary outer support and a rear section of said skimmer being connected to said primary outer support at said rear surface.

18. The golf club head of claim 1 wherein said primary outer support is further defined as an elongated, ribbon shaped member.

19. The golf club head of claim 4 wherein said skimmer is further defined by an outwardly protruding bulge adjacent said rear surface.

20. The golf club head of claim 4 wherein said skimmer is further defined by a rearward portion extending upwardly and onto said rear surface.

21. The golf club head of claim 20, wherein said skimmer further includes an outwardly protruding bulge adjacent said rear surface.

22. The golf club head of claim 4 wherein said skimmer includes a rearward portion which interconnects with said outer support member.

23. The golf club head of claim 4 wherein said skimmer is narrower in a front to rear direction as viewed from said bottom surface.

24. The golf club head of claim 4 wherein said skimmer is narrower in a rear to front direction.

25. The golf club head of claim 1 further including a single auxiliary outer support extending approximately midway on said upper surface in a front to rear direction.

26. The golf club head of claim 25 wherein said single auxiliary outer support extends from proximate said ball striking face to said rear surface.

27. The golf club head of claim 26 wherein said single auxiliary outer support connects to said primary outer support member at said rear surface.

28. The golf club head of claim 1 wherein said primary outer support member is discontinuous at said rear surface.

29. The golf club head of claim 1 further including a plurality of ground engaging skimmers on said bottom surface.

* * * * *